United States Patent [19]

Skorka

[11] Patent Number: 4,821,923

[45] Date of Patent: Apr. 18, 1989

[54] MANUALLY OPERABLE DISPENSER FOR MEDIA WITH MULTIPLE COMPONENTS

[75] Inventor: Thomas Skorka, Radolfzell, Fed. Rep. of Germany

[73] Assignee: Ing. Erich Pfeiffer GmbH & Co. KG, Fed. Rep. of Germany

[21] Appl. No.: 105,884

[22] Filed: Oct. 7, 1987

[51] Int. Cl.[4] ..... B67B 7/24

[52] U.S. Cl. ..... 222/80; 222/145; 222/382; 206/219; 215/DIG. 8

[58] Field of Search ..... 206/222, 219; 215/DIG. 8; 222/80–82, 88, 136, 145, 321, 382; 604/82, 86, 87, 88, 89, 91

[56] References Cited

U.S. PATENT DOCUMENTS

| | | | |
|---|---|---|---|
| 2,829,801 | 4/1958 | Ayres | 222/82 |
| 3,134,505 | 5/1964 | Modderno | 222/82 |
| 3,240,403 | 3/1966 | Modderno | 222/399 |
| 3,302,832 | 2/1967 | Haroman et al. | 222/94 |
| 3,355,238 | 11/1967 | Schwartzman | 222/80 |
| 3,441,177 | 4/1969 | Treharne | 222/82 |
| 3,648,899 | 3/1972 | Lukesch et al. | 222/82 |
| 3,655,096 | 4/1972 | Easter | 222/82 |
| 4,019,512 | 4/1977 | Tehczar | 222/80 |
| 4,088,246 | 5/1978 | Klingaman | 222/88 |
| 4,201,316 | 5/1980 | Klingaman | 222/80 |
| 4,676,775 | 6/1987 | Zolnierczyk | 604/87 |

*Primary Examiner*—H. Grant Skaggs

*Attorney, Agent, or Firm*—Steele, Gould & Fried

[57] ABSTRACT

A dispenser (1) has an admixing chamber (5) for each of the admixing components to be mixed together in a main chamber (4), the admixing chamber being inserted in a mount (7) of main chamber (4) formed by a vessel neck. A partition of the admixing chamber (5) is essentially constructed as a closure part (17), which is connected in one piece with admixing chamber (5) by means of a predetermined breaking point (18) and forms a component of a riser tube (6). For putting the discharge apparatus into operation a closure is opened and a discharge pump (3) within mount (7) is so introduced into admixing chamber (5) that the discharge pump (3) is connected with a suction connection (27) accompanied by the opening of a tube connection with riser tube (6) and then through further axial displacement of tube (6) the closure part (17) is broken free, so that the component flows from admixing chamber (5) into main chamber (4). Through the operation of discharge pump (3), the mixing medium can be discharged directly via the discharge channel (38) of the discharge pump (3).

29 Claims, 2 Drawing Sheets

MANUALLY OPERABLE DISPENSER FOR MEDIA WITH MULTIPLE COMPONENTS

Figure 1:
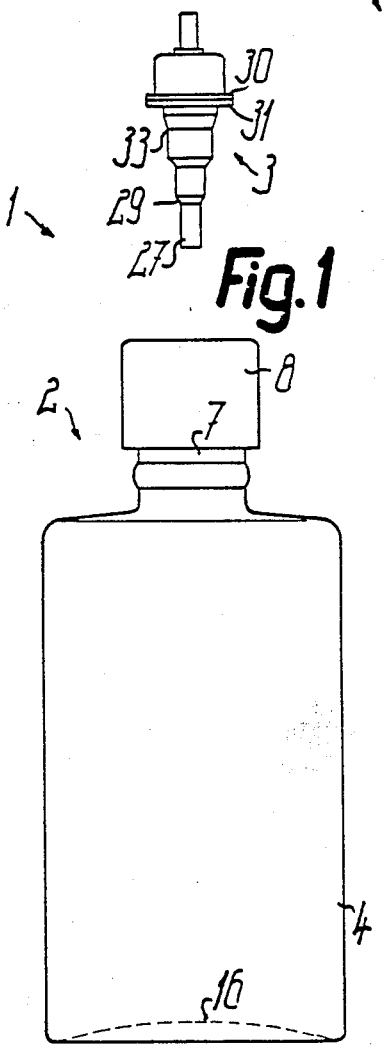

This invention relates to a Dispenser for media to be mixed from at least two components.

Technical, pharmaceutical, cosmetic and similar agents or media often consist of several components, which should be mixed together as shortly as possible before use for reasons of a reaction time or because in the mixed state they tend towards changes, e.g. a shorter life. Thus, as a rule, such mixed media are made available separately from one another in separate containers and prior to use the admixing component must be added to the main component following the opening of the associated container cover and is then thoroughly mixed therewith. This requires certain skill and a high degree of care, if it is a question of ensuring that the components are mixed together in a precise mixing ratio. If at least one component is of the type that direct contact with the air is prejudicial thereto, mixing can only take place under laboratory conditions.

The problem of the present invention is to provide a dispenser, in which it is possible to carry out the admixing of at least one component with at least one further component in a simple manner, so that a reliable and complete transfer of one component into the chamber of the other component is ensured and that subsequently the mixed medium can be directly discharged from the associated chamber for use.

For solving this problem, in the case of a dispenser of the aforementioned type, at least one intermediate chamber is immediately adjacent to the main chamber via closure part, that the latter can be separated by means of a predetermined breaking point from the closure position and that the main chamber has a mount for a manually operable discharge means like preferably a discharge pump to be connected to its inner area at the suction side. The intermediate chamber and the main chamber are e.g. directly line-interconnected by means of a passage opening provided in a common partition and which is initially closed with the closure part, so that after separating the closure part, the passage opening is open over substantially its entire width precisely defined by its dimensionally stable boundary and the content of one chamber can be directly transferred into the other chamber without any leakages. The components to be mixed, which are appropriately flowable, can be liquids, pulverulent substances, gases, etc. and each of said aggregate forms can be provided for mixing with a random of the two other aggregate forms. For example, the admixing component can be pulverulent and the main component liquid. However, it is also conceivable for at least one component to be formed by at least one, e.g. soluble or catalytically acting solid, which as a result of the inventive construction can be brought into contact as a whole with the other component, because the closure completely frees the transfer or passage path or opening. The manually operable discharge pump connected to the main chamber in the operating state permits the very simple discharge of the mixed medium e.g in precisely dosed quantity units, so that in particular such mixed media can be used, whose aerosols or similar propellants are prejudicial.

Although U.S. Pat. No. 3,240,403 discloses a discharge apparatus with two chambers separated by an intermediate cover, in which the upper chamber contains the medium to be discharge and the lower chamber a propellant gas, it does not serve as a mixture component, but merely for producing a pressure feeding the medium via a valve head to the outside. A cover plate between the two chambers is held under gas pressure in the closed position, so that this construction is not suitable for mixing together mixing components kept separate in the manner of the present invention. In another discharge apparatus known from U.S. Pat. No. 3,134,505, the closure between two chambers is constituted by a membrane or diaphragm to be destroyed by a riser tube of a valve head and which generally tends to engage relatively closely around the riser tube, so that if the upper chamber was intended to receive an admixing component, it would not be possible to ensure a reliable passage of said admixing component into the main chamber. Due to the fact that in the invention, the closure part is separable by at least one predetermined breaking point, the aforementioned disadvantages are avoided.

A particularly advantageous further development of the invention comprises the admixing chamber being inserted in the discharge pump mount preferably constructed in the manner of a container neck, so that in the case of a normal positioning of the main chamber, it is generally positioned above the content thereof and therefore the admixing chamber content passes under its own weight and automatically into the main chamber following the opening of the closure part. It is admittedly conceivable to construct the partitions of the admixing chamber in one piece with those of the main chamber, but a particularly easily manufactured and handled construction is obtained if the admixing chamber is provided in the form of a separate container inserted in the main chamber, which preferably sealingly engages on the outer end face of the mount for the discharge pump with a flange ring.

If the closure part is provided in a bottom wall of the preferably cup-shaped admixing chamber and takes up in particular approximately the entire bottom wall, then for opening the connection between the admixing chamber and the main chamber virtually the entire associated partition is broken out, so that it is particularly reliably ensured that the entire content of the admixing chamber passes into the main chamber.

The construction and handling of the inventive discharge apparatus can be further simplified in that the closure part is openable by the discharge pump insertable from the outside into a chamber, particularly the admixing chamber, so that the discharge pump is made available initially separately from the container forming the admixing and main chambers and for mixing the components the discharge pump detachable as an entity from the container need only be fitted in it operation position to the latter.

If the closure part forms a fixed component with a riser tube for the discharge pump, which is only connected to the latter on inserting the discharge pump in the container, there is no need to use the relatively sensitive and therefore easily damageable inner end of the riser tube for opening the closure part and it is also possible to avoid that after opening the closure part is located in an uncontrolled position in the main chamber. As a result the closure part can on the one hand be constructed in one piece with the riser tube and on the other hand in one piece with the admixing chamber, so that according to a preferred embodiment the admixing chamber, closure part and riser tube are formed by a single one-piece component made from plastic or the like. The one-piece construction of the closure part with the admixing chamber and the connection of the closure part to the admixing chamber exclusively via the predetermined breaking point also permits, without any particular effort and expenditure, to provide an extremely tight construction of the admixing chamber, so that even in the least favourable cases no parts of the admixing component can unintentionally enter the main chamber.

In order that the riser tube does not provide a line connection between the admixing chamber and the main chamber, it is possible to provide any random closure or seal which can be opened from the outside, e.g. being conceivable to provide a closure cap for the container neck or the admixing chamber on its inside with a closure member for the riser tube, so that said closure member is removed from the riser tube simultaneously with the removal of the closure cap. However, it is particularly advantageous for the hermetic closure or sealing of the riser tube, if the tube closure thereof is connected in one piece with the riser tube via a predetermined breaking point and is positioned in such a way that it can also be opened through the discharge pump insertable from the outside.

Advantageously the tube closure is positioned in protected manner within the riser tube, whose outer end is appropriately constructed as an outer socket for receiving a discharge pump casing end connection in the form of a suction connection. On inserting the discharge pump the tube closure is thereby automatically broken free and therefore opened. The tube closure can be constructed in such a way that it is formed from individual segments, which are connected to one another via further predetermined breaking points and are detached from one another on opening, said segments then in each case having a maximum width, which is smaller than the internal width or diameter of the inner channel of the riser tube, so that it is reliably ensured that the broken free tube closure does not remain stuck in the riser tube and instead drops entirely into the main chamber, where it is not a hinderance.

In order to ensure a reliable connection between the discharge pump and the riser tube, it is advantageous if the predetermined breaking point of the tube closure has a lower breaking force than the predetermined breaking point of the closure part, so that the latter is only broken free when the plug connection between discharge pump and riser tube has been made. However, it is also conceivable to provide for the inner end of the riser tube a stop e.g. formed by the opposite bottom of the main chamber, against which strikes the inner end of the riser tube in a position corresponding to its operating position connected to the discharge pump, so that on inserting the said pump firstly the closure part can be opened and then, accompanied by the breaking free of the tube closure, the final operating connection between discharge pump and riser tube is made. In this case, the inner end of the riser tube or the stop is constructed in such a way that in the operating position instead of the inner end being closed, it is e.g. open laterally in the jacket for sucking in the mixed medium.

The inventive construction is particularly suitable for discharge apparatuses, in which the discharge pump is constructed as a thrust piston pump, whose pump chamber is preferably connected by means of an inlet valve with the suction connection and whose discharge channel more particularly located in the piston rod has at least one outlet valve. This discharge pump is suitable for both liquid and pasty media, can be adjusted to precisely dosed discharge quantities and also permits an atomized or sprayed discharge of the mixed medium. Such a discharge pump also has the important advantage that as a result of the fact that the outlet valve and a ventilation or aeration means optionally provided therein for the main chamber are resiliently closed in the initial state, the life of sensitive mixed media can be significantly increased.

This and further features of preferred further developments of the invention can be gathered from the description and drawings and the individual features can be realized singly or in the form of subcombinations in an embodiment of the invention and in other fields. An embodiment of the invention is described hereinafter relative to the drawings, wherein show:

FIG. 1 An inventive dispenser in elevation and in the stored state.

Figure 2:
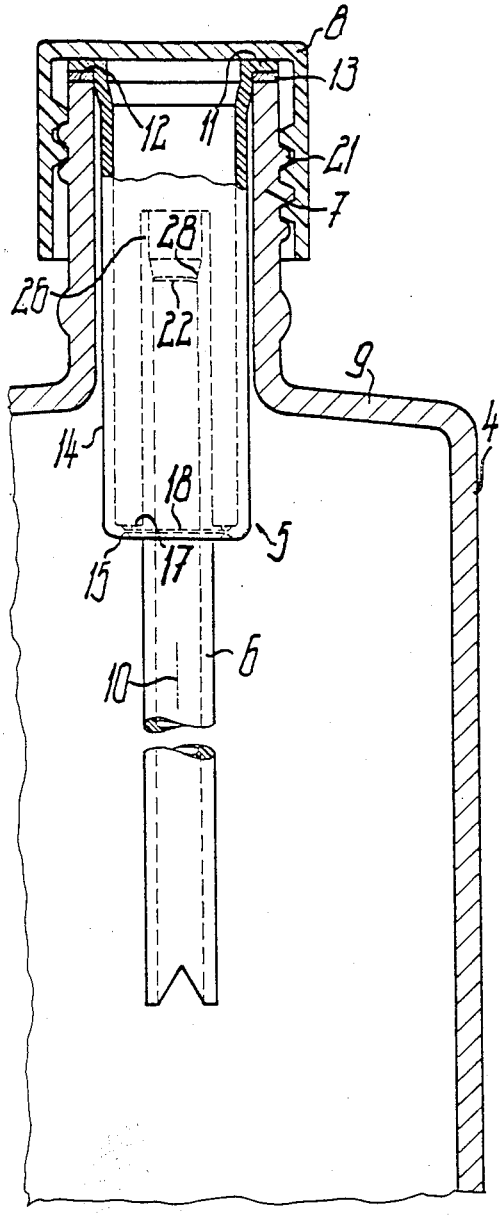

FIG. 2 A detail of the container of the dispenser of FIG. 1 in axial section.

Figure 3:
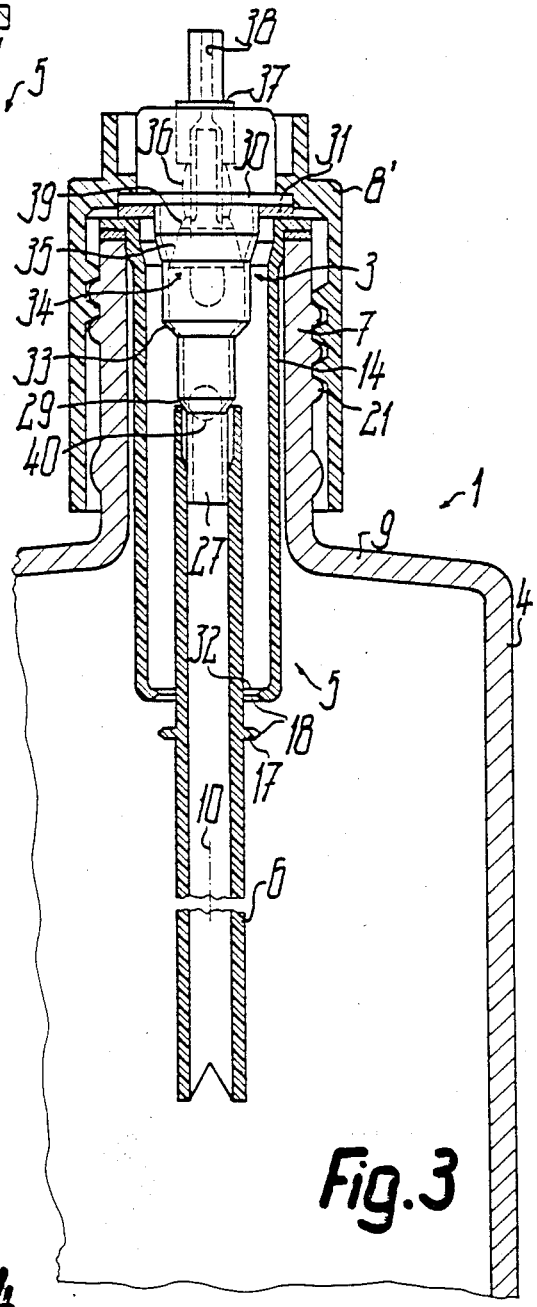

FIG. 3 The detail according to FIG. 2, but with the dispenser in the operating state.

Figure 4:
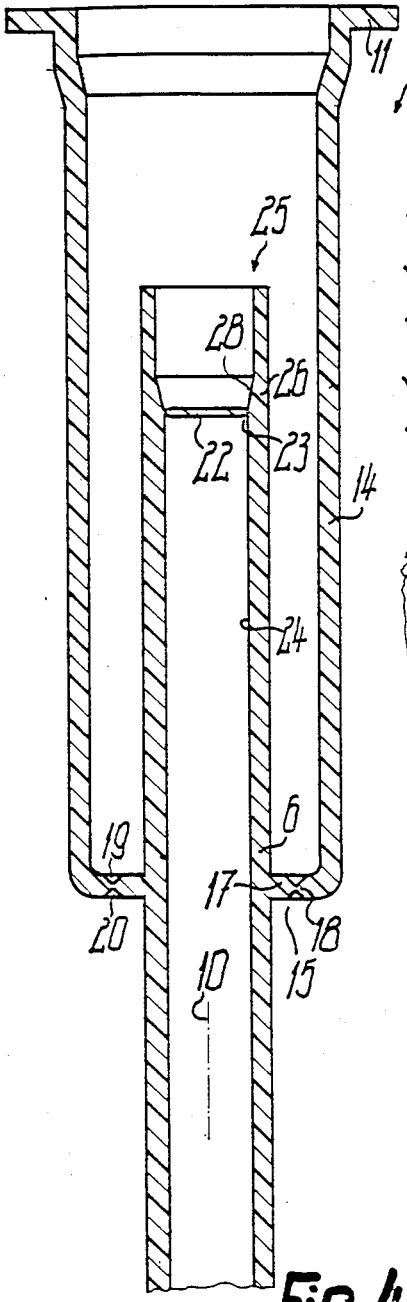

FIG. 4 The admixing chamber of the dispenser according to FIGS. 1 to 3 in a significantly larger-scale representation and in axial section.

As shown in FIGS. 1 to 4, an inventive dispenser 1 has a storage or reception container 2 for all the media components to be mixed and a discharge pump 3, in the form of a manually operable thrust piston pump, kept outside container 2 prior to the mixing and discharge of the components and which is connected to said container 2 for mixing the components and for discharging the mixed components according to FIG. 3.

Container 2 has a bottle-shaped outer container a main chamber 4, in which is inserted as an inner, much smaller volume container an admixing chamber 5 integrated with a riser tube 6. Both as regards its cross-sections and as regards its length or height, admixing chamber 5 is much smaller than main chamber 4. For receiving the admixing chamber 5, main chamber 4 is provided at its upper end wall 9 with a sleeve-like mount 7, whose inside diameter is much smaller than the inside diameter of the remaining main chamber 4 and which only projects outwards over the end wall 9. In the manner of a vessel neck, said mount 7 is constructed in one piece with all the remaining partitions of the main chamber 4 and also forms the filling opening for filling the main chamber 4 with the main component. The constant inside diameter of mount 7, which is substantialy continuous over its length is only slightly larger than the outer circumferential width of admixing chamber 5, which has constant cross-sections over approximately its entire height and engages in mount 7 with a limited gap spacing in such a way that its inner end projects inwards over end wall 9, but a large or its largest part is located within mount 7. Thus, admixing chamber 5 is connected in the manner of a simple plug connection with main chamber 4 and is centred with respect to mount 7 in its equiaxial position relative to the central axis 10 of discharge apparatus 1. At the outer end, admixing chamber 5 has a flange ring 11 projecting over its outer circumference and which has the same external cross-section as the associated end of mount 7 and engages on its end face 12, accompanied by the interposing of a circumferential joint 13. Adjacent to flange ring 11, admixing chamber 5 has a widened outside diameter portion for centring with respect to mount 7. The bottom partition 15 of the cup-shaped admixing chamber 5 open to its full width at its outer end is constructed in one piece with the jacket wall 14 of admixing chamber 5 and with the riser tube 6, which has constant cross-sections approximately over its entire length. A longitudinal portion of riser tube 6 projecting into admixing chamber 5 is shorter than the latter, so that the end of this longitudinal portion is located between partition 15 and the open end of admixing chamber 5 within the latter. The other longitudinal portion projects from the bottom partition 5 into main chamber 4, but in the state according to FIG. 2 has a relatively large spacing from its opposite bottom wall 16. A closure part 17 projects in collar-like manner over the outer circumference of riser tube 6 in the plane of bottom partitions 5. Part 17 at least forms a central portion of the bottom partition 15 and is connected in one piece with the part of the bottom partition or the jacket wall 14 connected to its outer circumference by means of a predetermined breaking point 18. The predetermined breaking point 18 formed by a considerable thickness reduction to the partition of admixing chamber 5 is defined on the inside or outside of the associated wall of admixing chamber 5 by at least one notch groove closed around central axis 10. In the represented embodiment, such notch grooves 19, 20 are substantially congruent and have the same cross-section or depth on both sides. The predetermined breaking point 18 can also have a width such that it is at least approximately the same as the inside diameter of admixing chamber 5. The outside diameter of riser tube 6, particularly of its part projecting into admixing chamber 5, is much smaller, e.g. half as large as the inside diameter of admixing chamber 5.

The closure cap 8 engages over mount 7 on the outside and is secured in its closure position with respect to mount 7 by suitable securing members. In the represented embodiment, said securing members 21 are formed by an external thread on mount 7 and an internal thread on the jacket of closure cap 8. They can also be formed by the elements of a snap or spring catch or by a separate securing member only detachable by destruction and which serves as a seal. The planar end wall of the closure cap 8 sealingly engages on flange ring 11 and presses the latter against mount 7, so that through the closure cap 8 on the one hand main chamber 4 and admixing chamber 5 are sealed with respect to one another and on the other each individual chamber is separately sealed with respect to the outside.

Following the removal of closure cap 8, the top surface of admixing chamber 5 is opened, so that said admixing chamber 5 can only be filled over part or approximately its entire height with the associated admixing component. In this state the main chamber 4 remains sealed with respect to the outside, i.e. here again admixing chamber 5 is sealed or closed with respect to the main chamber 4. This is achieved by a tube closure 22, which is provided in riser tube 5 within admixing chamber 5 and is positioned relatively close to the associated end of riser tube 6. The disk or membrane-like tube closure 22 is constructed in one piece with riser tube 6 and is connected to the boundary of its inner channel via an annular predetermined breaking point 23. The latter, which can also be formed by one or two notch grooves, is positioned in such a way that after breaking free the tube closure 22 substantially no ridge projects over the limiting face of inner channel 24. The tube closure 22 is located within a connection 25 provided for the plug connection with a suction connection 27 of discharge pump 3 and which is formed by the associated end of riser tube 6 constructed as an outer socket 26. The outer end portion of said outer socket 26 has a slightly larger inside diameter than the remaining riser tube 6 and with respect to the outer circumference of suction connection 27. This portion passes via an acute-angled, frustum-shaped, tapered intermediate part 28 into the connecting, narrower inner channel 24 and the tube closure 22 is located at the transition between intermediate part 28 and the remaining inner channel 24. The length of the further end portion of outer socket 26, is approximately half the length of suction connection 27, so that the latter can engage with approximately half its length in the connecting inner channel 24, whose inner cross-section is so adapted to the outer cross-section of suction connection 27, that the latter sealingly engages. Following the removal of closure cap 8, discharge pump 3 is inserted in admixing chamber 5 in such a way that the suction connection 27 is inserted in outer socket 26. After the end face of suction connection 27 has struck against the tube closure 22, the latter is broken free by further insertion of discharge pump 3, so that the suction connection 27 fully penetrates in its operating position according to FIG. 3 into the riser tube 6. On reaching this position the discharge pump 3 strikes with its end stop 29 against the associated end face of riser tube 6, said end stop 29 being formed by a frustum-shaped ring shoulder 29 connected to the suction connection 27 and which through further engagement in the inner edge of the outer socket 26 contributes to the further sealing of the connection between discharge pump 3 and riser tube 6. In this position the discharge pump 3 has still not reached its operating position with respect to container 2, in which it engages on the outer end face of the flange ring 11 with a ring flange 30 projecting over the outside of its casing and which is appropriately formed by an outer cylinder cover cap of the casing, accompanied by the interposing of a circumferential joint 31 and as a result the admixing chamber 5 is sealed. In order to completely pass into the operating position, the discharge pump 3 is pressed further into admixing chamber 5, whilst carrying with it via the end stop 29 the riser tube 6 which is connected in clamped manner therewith, accompanied by the breaking of the predetermined breaking point 18. Thus, the closure part 17 is completely released from the admixing chamber 5, so that around the riser tube 6 is freed an annular passage opening 32 from admixing chamber 5 to main chamber 4. The admixing component in admixing chamber 5 automatically flows into main chamber 4, in which it is brought together with the main component located therein and is optionally mixed by shaking. This thorough mixing is aided by the admixing chamber 5 projecting into main chamber 4 and the ring plate-like closure part 17, because these parts help to whirl up the flow.

The discharge pump 3 is secured by a sleeve which replaces the closure cap 8 and appropriately secures through the same securing members 21 of mount 7 as the closure cap 8, i.e. is constructed in the represented embodiment as a screw sleeve 8', with which the discharge pump 3 can be secured. However, it is also conceivable to secure the sleeve surrounding the mount 7 on the outer circumference and engaging on ring flange 30 by securing members other than the closure cap 8 with respect to mount 7, e.g. in that it is engaged in the manner of a snap catch.

In the represented embodiment the discharge pump 3 is constructed as a thrust piston pump, whose cylinder casing projecting into admixing chamber 5 and whose external diameter is reduced several times with respect to the suction connection 27 is spaced over its entire length from the inner circumference of admixing chamber 5. Discharge pump 3 has a piston unit 34 displaceable in cylinder casing 33 and having an elastic piston sleeve 35, which is constructed at its outer end in one piece with an elastically resilient compression sleeve 36. Piston sleeve 35 and compression sleeve 36 are arranged on the outer circumference of a piston rod 37, which is traversed by a discharge channel 38 leading to its end located outside the pump casing. In the transistion region to the compression sleeve 36, the piston sleeve 35 forms the outer, annular valve closure part of an outlet valve 39, whose valve seat is provided on the piston rod 37. The piston sleeve 35, including the valve closure part can be moved with respect to the piston rod 37 counter to the direction of the pump travel, accompanied by the recovery compression of the compression sleeve 36, so that outlet valve 39 opens. This movement can take place either towards the end of the pump travel by the piston sleeve 35 striking against an inner shoulder of the cylinder casing 33, either necessarily or in pressure-dependent manner through a corresponding overpressure in the pump chamber. Between the pump chamber and the suction connection 27 the discharge pump 3 has an inlet valve 40 in the form of a ball valve, which closes in the case of an overpressure in the pump chamber, i.e. during the pump travel.

I claim:

1. A dispenser for media to be mixed from at least two components, comprising:

a main chamber (4) and at least one admixing chamber (5) closed with respect to the main chamber (4);

a closure means (17) associated with said admixing chamber (5) for opening and transferring a component contained in the admixing chamber (5) into the main chamber (4), said closure means (17) providing a closure position, wherein the closure means (17) of at least one of said at least one admixing chambers (5) is provided in a duct connection directly connecting the main chamber (4) to the admixing chamber (5), the closure means (17) being separable from the closure position by means of a predetermined breaking zone (18), the main chamber (4) having a mount (7) for a manually operable discharge means (3) for discharging said media from the main chamber (4);

said discharge means (3) having an inlet and having a riser duct (6), said closure means (17) forming a common construction component with said riser duct (6), the riser duct forming a riser tube, the closure means (17) being provided in collar-like manner on an outer circumference of the riser duct (6).

2. A dispenser for media to be mixed from at least two components, comprising:

a main chamber (4) and at least one admixing chamber (5) closed with respect to the main chamber (4);

a closure means (17) associated with said admixing chamber (5) for opening and transferring a component contained in the admixing chamber (5) into the main chamber (4), said closure means (17) providing a closure position wherein the closure means (17) of at least one of said at least one admixing chamber (5) is provided in a duct connection directly connecting the main chamber (4) to the admixing chamber (5), the closure means (17) being separable from the closure position by means of a predetermined breaking zone (18), the main chamber (4) having a mount (7) for a manually operable discharge means (3) for discharging said media from the main chamber (4);

said discharge means (3) having an inlet and a riser duct (6), said closure means (17) forming a common construction component with said riser duct (6), said riser duct (6) is provided with a duct closure means (22) openable from the outside of the dispenser (1), said duct closure means (22) being connected in one piece with said ruser duct (6) by means of a predetermined breaking zone (23), said predetermined breaking zone (23) of the duct closure means (22) having a lower breaking force than said predetermined breaking zone (18) of said admixing chamber closure means (17).

3. A dispenser for media to be mixed from at least two components, comprising:

a main chamber (4) and at least one admixing chamber (5) closed with respect to the main chamber (4);

a closure means (17) associated with said admixing chamber (5) for opening and transferring a component contained in the admixing chamber (5) into the main chamber (4), said closure means (17) providing a closure position wherein the closure means (17) of at least one of said at least one admixing chambers (5) is provided in a duct connection directly connecting the main chamber (4) to the admixing chamber (5), the closure means (17) being separable from the closure position by means of a predetermined breaking zone (18), the main chamber (4) having a mount (7) for a manually operable discharge means (3) for discharging said media from the main chamber (4);

said discharge means (3) having an inlet and a riser duct (6), said closure means (17) forming a common construction component with said riser duct (6), said riser duct (6) providing an inner channel (24) having a conical intermediate portion with a narrower transition, said riser duct (6) having a duct closure means (22) openable from outside of the dispenser (1), said duct closure means (22) being provided at the narrower transition of the conical intermediate portion (28) along the inner channel (24) of the riser duct (6).

4. A dispenser according to claim 3, wherein said inner channel (24) has a widening end portion.

5. A manually operable dispenser for media to be discharged after being mixed from at least two components, comprising:

a main chamber (4) and at least one admixing chamber (5) closed with respect to the main chamber (4);

a closure means (17) associated with said admixing chamber (5) for opening and transferring a component contained in the admixing chamber (5) into the main chamber (4), said closure means (17) having a closure position, said closure means (17) of at least one of said at least one admixing chamber (5) being provided in a duct connection directly connecting the main chamber (4) to the admixing chamber (5), the enclosure means (17) being moveable from the closure position into an open position, the main chamber (4) having a mount (7) for a manually operable discharge means (3) for discharging said media from the main chamber (4), said discharge means (3) having an inlet associated with an inlet duct (6), wherein said closure means (17) is a component of said inlet duct (6) extending to the main chamber (4) at least in the open position of said closure means (17) and acessibly arranged for transferring said closure means (17) from the closure position to the open position.

6. A dispenser according to claim 5, wherein said closure means (17) and said inlet duct (6) are separable from a common closure position by means of a predetermined breaking zone (18).

7. A dispenser according to claim 6, wherein said closure means (17) and said inlet duct (6) form a one-part construction component defining said breaking zone (18).

8. A dispenser according to claim 6, wherein the closure means (17) of said component is a solid closure part (17) forming a flat cover connected by an outer circumference comprising the predetermined breaking zone (18), constructed as a weakened cross-sectional zone in one part with an associated chamber wall.

9. A dispenser according to claim 5, wherein said discharge means (3) is a discharge pump having a suction inlet (27) to be connected to an inside area of the main chamber (4) via said inlet duct (6) of said component.

10. A dispenser according to claim 9, wherein said discharge pump (3) is constructed as a thrust piston pump for connection with the inlet duct (6) of said component.

11. A dispenser according to claim 5, wherein at least one said admixing chamber (5) is provided at least partly in the main chamber (4), said admixing chamber (5) bearing said inlet duct (6) in the closure position of said closure means (17).

12. A dispenser according to claim 5, wherein said mount (7) of the main chamber is constructed in the manner of a vessel neck, at least one said admixing chamber (5) being inserted in said mount (7) of the main chamber (4) commonly with said inlet duct (6), said main chamber (4) having an outer end face (12), said at least one admixing chamber (5) being provided in the form of a separate receptacle sealingly engaging on said outer end face (12) with a flange ring (11), said discharge means (3) having a ring flange (30) for sealed supporting upon the mount (7) of the main chamber and on the flange ring (11) of the admixing chamber (5).

13. A dispenser according to claim 5, wherein at least one said admixing chamber (5) has a bottom wall (15), said closure means (17) being provided in the bottom wall (15) of said admixing chamber (5) and taking up substantially the entire bottom wall (15) surrounding said inlet duct (6).

14. A dispenser according to claim 5, wherein said dispenser has an external boundary, said closure means (17) being accessible for opening at least indirectly from said external boundary, means being provided for opening the closure means (17) by inserting said discharge means (3) from the outside into said admixing chamber (5).

15. A dispenser according to claim 14, wherein the inlet duct (6) has a connecting member (25) for connection to the discharge means (3) during insertion into said admixing chamber (5).

16. A dispenser according to claim 15, wherein the connecting member (15) is formed by an outer end of the inlet duct (6), said outer end forming an outer plug socket (26).

17. A dispenser according to claim 5, wherein in the closure position of said closure means (17) the inlet duct (6) projects beyond the closure means (17) into the admixing chamber (5).

18. A dispenser according to claim 5, wherein in the closure position of said closure means (17) the inlet duct projects beyond the closure means (17) into the main chamber (4).

19. A dispenser according to claim 5, wherein in addition to said closure means for the admixing chamber, the inlet duct (6) is provided with an inner duct closure means (22) openable from outside of the dispenser (1).

20. A dispenser according to claim 19, wherein the duct closure means (22) is connected integrally in one place with a tube portion forming the inlet duct (6) by means of a predetermined breaking zone (23).

21. A dispenser according to claim 20, wherein the duct closure means (22) is located inside said tube portion.

22. A dispenser according to claim 20, wherein the duct closure means (22) is formed by a membrane-like thin cover having an outer circumference connected in one piece with, and comprising the predetermined breaking zone (18) to, an inner circumferential surface of the inlet duct (6), said breaking zone (18) being annular and provided between ends of said tube portion.

23. A dispenser according to claim 19, wherein a connecting member (25) for attaching said discharge means is provided, said duct closure means (22) being located in a vicinity of said connecting member (25).

24. A dispenser according to claim 5, wherein said discharge means (3) is provided with an inner end having a suction connection (27) for a plug connection with the inlet duct (6) of said component.

25. A dispenser according to claim 5, wherein said discharge means (3) is provided with an axial end stop (29) for the inlet duct (6) of said component.

26. A dispenser according to claim 5, wherein a closure cap (8) is provided for closing at least one of said main and admixing chambers instead of and prior to insertion of said discharge means (3), common means being provided for tensioning the discharge means (3) against the mount (7) with a screw sleeve (8') and for bearing a closure cap (8).

27. A dispenser according to claim 5, wherein said discharge means (3) has a pump chamber to be connected by means of an inlet valve (40) to the inlet duct of said component.

28. A dispenser according to claim 5, wherein said discharge means (3) has a discharge duct (38) with at least one outlet valve (39).

29. A dispenser according to claim 28, wherein said discharge means (3) has an operating rod (37), said discharge duct (38) being provided in said operating rod.

* * * * *

UNITED STATES PATENT AND TRADEMARK OFFICE

CERTIFICATE OF CORRECTION

PATENT NO. : 4,821,923

DATED : April 18, 1989

INVENTOR(S) : Thomas Skorka

It is certified that error appears in the above-identified patent and that said Letters Patent is hereby corrected as shown below:

Column 5, line 56 after "tube" delete "5" and insert --6--.

Column 8, line 12 delete "ruser" and insert --riser--.

Signed and Sealed this

Second Day of July, 199

*Attest:*

*Attesting Officer*

HARRY F. MANBECK, JR.

*Commissioner of Patents and Trademarks*